United States Patent [19]

Winter, IV

[11] Patent Number: 4,907,383

[45] Date of Patent: Mar. 13, 1990

[54] BOWED ROOF STRUCTURE, STRUCTURE PANEL AND METHOD FOR USING SAME

[76] Inventor: Amos G. Winter, IV, Pinnacle Springs Rd., Spofford, N.H. 03462

[21] Appl. No.: 273,685

[22] Filed: Nov. 21, 1988

Related U.S. Application Data

[63] Continuation-in-part of Ser. No. 70,065, Jul. 6, 1987, abandoned, which is a continuation-in-part of Ser. No. 41,934, Apr. 27, 1987, abandoned.

[51] Int. Cl.[4] ..... E04B 1/32

[52] U.S. Cl. ..... 52/86; 52/309.9

[58] Field of Search ..... 52/80, 81, 86, 309.9

[56] References Cited

U.S. PATENT DOCUMENTS

| | | | |
|---|---|---|---|
| 5,170 | 6/1847 | Preston | 52/89 |
| 2,535,883 | 12/1950 | Williamson | 52/224 |
| 2,897,668 | 8/1959 | Graham | 52/81 |
| 3,138,898 | 6/1964 | Carter | 52/408 |
| 3,390,211 | 6/1968 | Ziegler | 52/224 |
| 3,443,347 | 5/1969 | Varnell | 52/224 |
| 3,464,168 | 9/1969 | Russell | 52/86 |
| 3,466,821 | 9/1969 | O'Shanghnessy | 52/593 |
| 3,520,092 | 7/1970 | Petrik | 52/80 |
| 3,763,608 | 10/1973 | Chamlee | 52/80 |
| 4,023,317 | 5/1977 | Bettger | 52/80 |
| 4,425,065 | 1/1964 | Sweeney | 411/23 |
| 4,655,013 | 4/1987 | Ritland | 52/80 |
| 4,686,804 | 8/1987 | Smith | 52/80 |

FOREIGN PATENT DOCUMENTS

| | | | |
|---|---|---|---|
| 762542 | 7/1971 | Belgium | 52/309.9 |
| 91534 | 4/1982 | European Pat. Off. | 52/89 |
| 2525539 | 12/1976 | Fed. Rep. of Germany | 52/612 |
| 81730 | 7/1919 | Switzerland | 52/612 |
| 1525983 | 9/1978 | United Kingdom | 52/80 |
| 2130620 | 6/1984 | United Kingdom | 52/80 |

OTHER PUBLICATIONS

American Builder, Aug. 1942, p. 42.

*Primary Examiner*—Henry E. Raduazo
*Attorney, Agent, or Firm*—George W. Dishong

[57] ABSTRACT

A unique bowed prefabricated structural building panel and a bowed roof for a building using the panel. The panel preferably having a light weight rigid highly insulative foam bore bonded to inner and outer skins and having a bowed configuration which when assembled with similar panels creates a bowed structural wall and/or a bowed structural roof. A method for building a bowed roof for a building such as a cap house by assembling a plurality of bowed structural prefabricated panels in edge-to-edge relationship to create the bowed configuration on the roof.

13 Claims, 3 Drawing Sheets

BOWED ROOF STRUCTURE, STRUCTURE PANEL AND METHOD FOR USING SAME

BACKGROUND OF THE INVENTION

1. Field of the Invention

This application is a continuation-in-part of application serial No. 070.065 filed July 6, 1987 now abandoned, which application was a continuation-in-part of application serial No. 041,934 filed on Apr. 27, 1987 and now abandoned.

This invention relates to the field of prefabricated wall, roof and floor panels and more particularly to unique panels which may be fabricated in a novel way from smaller panel pieces, so as to continue the skin strength (both compression and tensile) and which panels have incorporated novel means for more securely, efficiently and economically joining such panels to form either structural/load bearing walls or non-structural/-non-load bearing walls which may be highly insulative with substantially no thermal bridges. Even more particularly this invention relates to a prefabricated structure panel having a highly insulative core located between two skins bonded to the two major surfaces which panel has a bowed configuration and when assembled in edge-to-edge relationship with complementary mating edges i.e., which edges abuttingly match the edges of similarly configured adjacent panels, form a bowed roof or a bowed wall of a structure such as the bowed roof in a so called "BOWED ROOF CAPE" or "BOWED CAPE" and the method of construction a "BOWED ROOF CAPE" using the bowed prefabricated structural panel to create the bowed roof.

2. Description of the Prior Art

The rising cost of labor and materials have made building construction and especially the construction of homes increasingly more expensive. In addition the cost of heating and cooling a building has increased many times over in recent years. In order to keep the costs of construction, heat, cooling and maintenance within reasonable limits and therefore affordable to the general public, innovations have been necessary. In part because of the availability of prefabricated structure-wall and curtain-wall panels of the type discussed herein, there has been a return to the post and beam type of modular construction which lends itself to a prefabrication of the many construction components away from the construction site. By prefabricating and precutting many of the components of the structure at a manufacturing facility, many procedures may be used to improve the fabrication efficiency and improve the quality of the components as well as reduce the construction time.

Prefabricated panels that may or may not be load bearing are provided at the construction site and are designed to be used with the post and beam construction. The panels which do not carry a load are sometimes referred to as curtain wall panels and can be used to rapidly enclosed the post and beam frame. The exterior or outer skin of the panel is provided ready for siding to be applied and the inside or inner skin of the panel is provided ready for application of any desired interior finish. Currently the panels, whether they are structure-wall panels (load bearing) or curtain-wall panels (non-load bearing), are connected one to the other along the vertical edges of the panels by what is referred to as splines or stud posts. These splines or stud posts unfortunately introduce thermal bridges. Further, the joint of adjacent wall so joined by the stud posts, whether by mechanical or by gluing means, do not continue the strength of the panel skins. In U.S. Pat. No. 4,578,909 smaller than normal load bearing panels are shown assembled without the use of stud posts. Such an assembly requires that the panels have either the foam insulation extend beyond the panel skins or the panel skins extend beyond the foam insulative core. The two types of panel edges can then be alternatively abutted and fastened, by glueing for example, to form a wall. It should be clearly noted that the assembled wall does not provide for a panel or wall skin which has continuous strength from panel to panel.

It would be advantageous to provide a prefabricated insulative panel all of which are the same as far as the design of the core and skin configuration and none of which would require the use of an additional component such as a spline or stud post to attach panels to form a larger panel or wall. In addition to the stud posts being an additional component they also reduce the effective insulative property of the completed building because they create thermal bridges. Thus the elimation of the stud post or splines improves the thermal efficiency of the completed building in addition to enhancing the construction efficiency and reducing the cost.

Simply abutting the edges of the present prior art panels against stud posts by inserting the stud post in a slot in the panel or abutting panel edge to panel edge by inserting the extended foam core or one panel into a slot in the adjacent panel, in addition to the above shortcomings, does not provide for a very strong joint. It would therefore be desireable to provide a joining system which would be strong, would accurately align adjacent panels, would maintain thermal integrity, would minimize material waste (door and window cut-outs could be reassembled into full sized panels), reduce construction labor costs and which is simple and low in cost and would allow a continuous, homogeneous panel to be made from smaller panel pieces.

Presently, homes which have bowed walls and/or bowed roofs are constructed using, in the instance of the bowed roof, rafters which are cut, sawn or laminated to have the appropriate arc or radius to create the bowed roof configuration. The roof skin is then constructed over or between the rafters using conventional and well known construction methods. Likewise, the inner surface had to be finished if the inner surface of the roof was to be a finished surface or a decorated surface. Where appropriate, insulation was also incorporated into the roof.

There are also available homes and/or structures which have roofs which are bowed inwardly or in other words concave instead of convex. Again, the known methods of conventional construction require the use of a relatively complex framing system of concave rafters etc. The roof skin is constructed similarly to the roof for the convex or bowed roof structure and similarly for a structure having a domed roof.

In addition to the above described advantageous panels, it would be desireable to have panels similarly made but which would have a bowed configuration allowing for the construction with prefabricated panels of bowed walls, bowed/convex or domed roofs and concave roofs (collectively referred to herein as non-planar walls or non-planar roofs) without the need to fabricate, by lamination or by other well known means, bowed rafters and other similarly configured components which make up the relatively complex framing system. The advantages of bowed roofs and bowed walls are relatively obvious to those of ordinary skill in the art of home or building design and construction. Among some of the advantages are increased living space and permitting new design variations with prefabricated panel constuction. Where the bowed prefabricated panels are structural panels, it is possible to construct a bowed roof or a bowed wall for example without the need for bowed rafters and bowed wall stud configuration thereby, for the bowed roof, increasing the useable space available on the second and the third level of the building. Bowed non-structural prefabricated panels having proper joining systems incorporated therein could readily be used as curtain wall (non-structural) panels or placed over bowed roof rafters and would thereby eliminate the construction step of insulating the roof when the panel is provided with an insulative foam core.

In U.S. Pat. No. 4,373,312 there is described a prefabricated panel construction system using self-drilling threaded fasteners, metal strips embedded in the panels to provide anchors for the threaded fasteners and specially adapted unsulating member along one edges of each panel to provide mechanical support. In U.S. Pat. No. 4,625,472 there is described a lightweight structural building panel having a shape compatible for use in assembling a geodesic dome structure. It is important to note that the panels do not have a bowed configuration and could not be used in the manner described herein.

SUMMARY OF THE INVENTION

The present invention, in its most simple embodiment, is directed to a prefabricated structural panel, sometimes referred to as a stress skin panel, having a core material of uniform thickness of thickness which may vary or taper over the length and/or the width of the panel and bonded to at least one adjacent skin. The combination of the core and skin is preferably but not necessarily basically rectangular in shape and bowed from one shorter edge to the other shorter edge or from one longer edge to the other longer edge. The edges of the panels are configured to abuttingly match corresponding edges of similarly configured panels.

A fundamental objective of the invention is to provide prefabricated structural building panels wherein at least some of the panels comprise: a substantially homogeneous core of substantially uniform thickness which is bonded to at least one adjacent skin. The skin being of material different from the homogeneous core material. The core and skin in combination being substantially non-planar in shape. There are also first and second pairs of opposed panel edges, the first pair of opposed panel edges being parallel and being substantially non-linear and extending between the second pair of opposed panel edges, the second pair of opposed panel edges being parallel and substantially linear. The at least one adjacent skin further having a first cross sectional area parallel to the first pair of edges and a second cross sectional area parallel to the second pair of edges. The first pair of opposed and parallel panel edges having an edge configuration adapted to abuttingly interfit first edges of substantially identical panels and the edge configuration lying solely in the plane of the at least one adjacent skin. The edge configuration having a surface area substantially greater than the first cross sectional area of the skin and being of a character such that when a plurality of such panels are assembled in mating edge to mating edge relationship, tensile and compression forces are transmitted between adjacent panels in the plane of the skins. The second pair of opposed, linear and parallel panel edges having an edge configuraton adapted to abut and interfit second edges of substantially identical panels, said edge configuration lying solely in the plane of the at least one adjacent skin and having a surface area greater than the second cross sectional area of the skin, and being of such a character that when a plurality of the panels are assembled using a fastening means tensile and compressive forces are transmitted between adjacent panels in the plane of the skins.

It is a primary object of the invention to provide a prefabricated structural panel having a bowed configuration which can be used, in assembly with other panels, to form non-planar walls, bowed or domed roofs and concave roofs i.e. non-planar roofs and particularly a BOWED ROOF CAPE or BOWED CAPE where the non-planar roof is bowed/convex.

Another primary object of the invention is to provide a prefabricated non-structural (non-load bearing) panel having a bowed configuration which can be used, in assembly with other panels and bowed rafters, to form bowed walls and bowed roofs and particularly a BOWED ROOF CAPE or BOWED CAPE having additionally joints such as for example a captured scarf joint, a tongue and groove joint or a mortise and tenon joint on at least one of the edges configured to complementary mate or abuttingly match adjacent panels when such panels are assembled to form a wall or a roof and as a result of using such joints the skin strength is continuous over the entire skin surface of the assembled panels.

A further object of the present invention is to provide a bowed prefabricated panel having a highly insulative foam core an inner and an outer skin when panel is a structural (load bearing) panel.

A still further object of the present invention is to provide panels as described having additionally joints such as for example a captured scarf joint, a tongue and groove joint or a mortise and tenon joint on at least one of the edges configured to complementary mate or abuttingly match adjacent panels when such panels are assembled to form a wall or a roof and as a result of using such joints the skin strength is continuous over the entire skin surface of the assembled panel.

A further object of the present invention is to provide a prefabricated panel having a joining system that the edges have increased and sufficient surface area so that a proper adhesive such as for example a microencapsulated adhesive applied to an edge or to a plurality of edges will, upon joining the panels, result in a joint through which the strength of the panel skin will be continued.

A yet further object of the present invention is to provide a method of constructing a building structure having structure defining surfaces comprising at least four walls and a roof and wherein at least one of said defining surfaces as a non-planar configuration comprising the step of assembling a plurality of the prefabricated structural building panels as described herein in edge-to-edge relationship to form the non-planar surface or surfaces.

Another further object of the invention is to provide a non-planar roof for a building, such as for example a bowed roof cape house, the roof comprising a framing system having a ridge and at least one beam arranged or configured to support a plurality of the bowed panels described herein where the span of the roof and other structural details so require the framing system. Where the span is too great and the structural panels insufficiently thick and where the walls are not tied together by flooring or otherwise only then is it necessary to provide such framing system.

Yet another further object of the invention is to provide a bowed roof of a building suitable for human habitation, with a roof comprising a framing system having a ridge and at least a beam the framing system configured to support a plurality of bowed prefabricated structural insulative building panels arranged in edge to edge relationship. The framing system is a system which is separate from the panels. At least some of the panels comprising: a substantially homogeneous core having substantially uniform thickness bonded to two adjacent skins, an outer and an inner skin, the skin or skins being of material different from said core material and having, therebetween and bonded thereto, the core preferably of insulative material. The core and skins in combination, being substantially rectangular with two short panel edges and two long panel edges the two short edges being linear, opposed and parallel one to the other and the two long edges being oppposed and parallel one to the other, and the two long edges having a bowed shape with a radius from one of the short edges to the other of the short edges, the radius of appropriate magnitude, at least one of the two adjacent skins further having a long cross sectional area parallel to the two long panel edges and a short cross sectional area parallel to the two short panel edges. The two opposed, linear and parallel short panel edges having an edge configuration adapted to abuttingly interfit short edges of abutting panels when abutting panels are placed in abutting and interfitting relationship, the edge configuration lying solely in the plane of at least one of the two adjacent skins and having a surface area greater than the short cross sectional area of the skin at at least one of the short panel edges and the configuration of at least one short edge of the two opposed, linear and parallel short edges of a character such that when a plurality of the panels are assembled in mating edge to mating edge relationship, tensile and compression forces are transmitted between adjacent panels in the plane of the skins and one of the two linear, parallel and opposing short edges of the panels and the abutting panels may be abutting at the beam.

The two long opposed and parallel edges have an edge configuration adapted to abuttingly interfit long edges of substantially identical panels which are placed in abutting and interfitting relationship, the edge configuration lying solely in the plane of at least one adjacent skin and having a surface area greater than the long cross sectional area of the skin at at least one of the long panel edges and the configuration of at least one long edge of the two opposed and parallel long edges of a character such that when a plurality of panels are assembled in mating edge to mating edge relationship, tensile and compression forces are transmitted between adjacent panels in the plane of the skins such that an assembly of a plurality of panels onto the framing system results in the bowed roof.

These and further objects of the present invention will become apparent to those skilled in the art after a study of the present disclosure of the invention.

BRIEF DECRIPTION OF THE DRAWINGS

Figure 5:
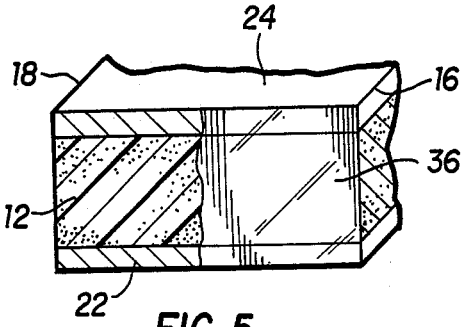
Figure 6:
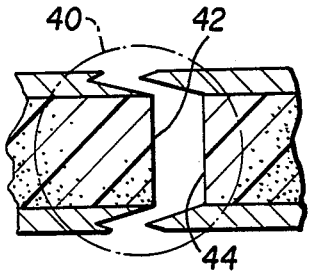
Figure 4A:
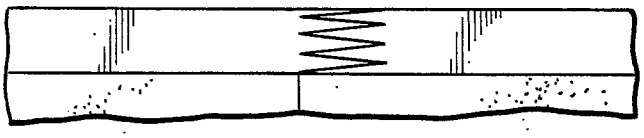
Figure 4B:
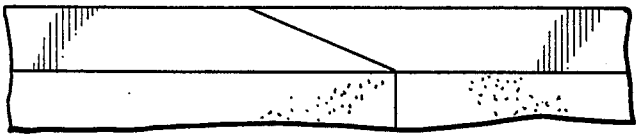
Figure 4C:
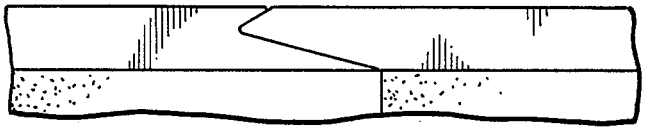
Figure 4D:
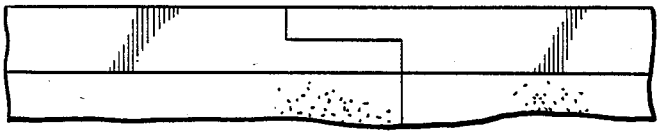
Figure 4E:
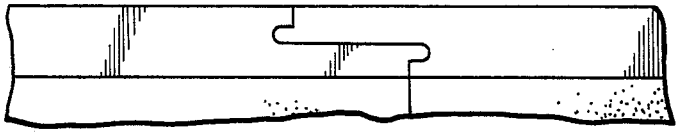
Figure 4F:
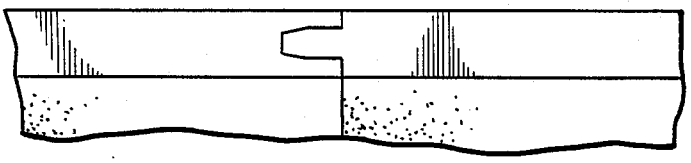
Figure 4G:
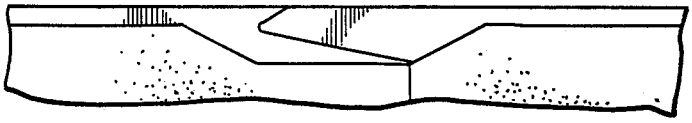
Figure 7A:
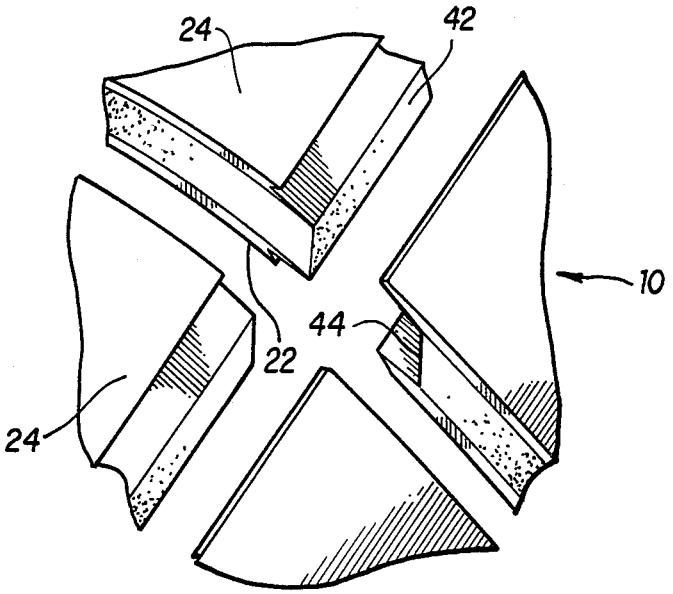
Figure 7:
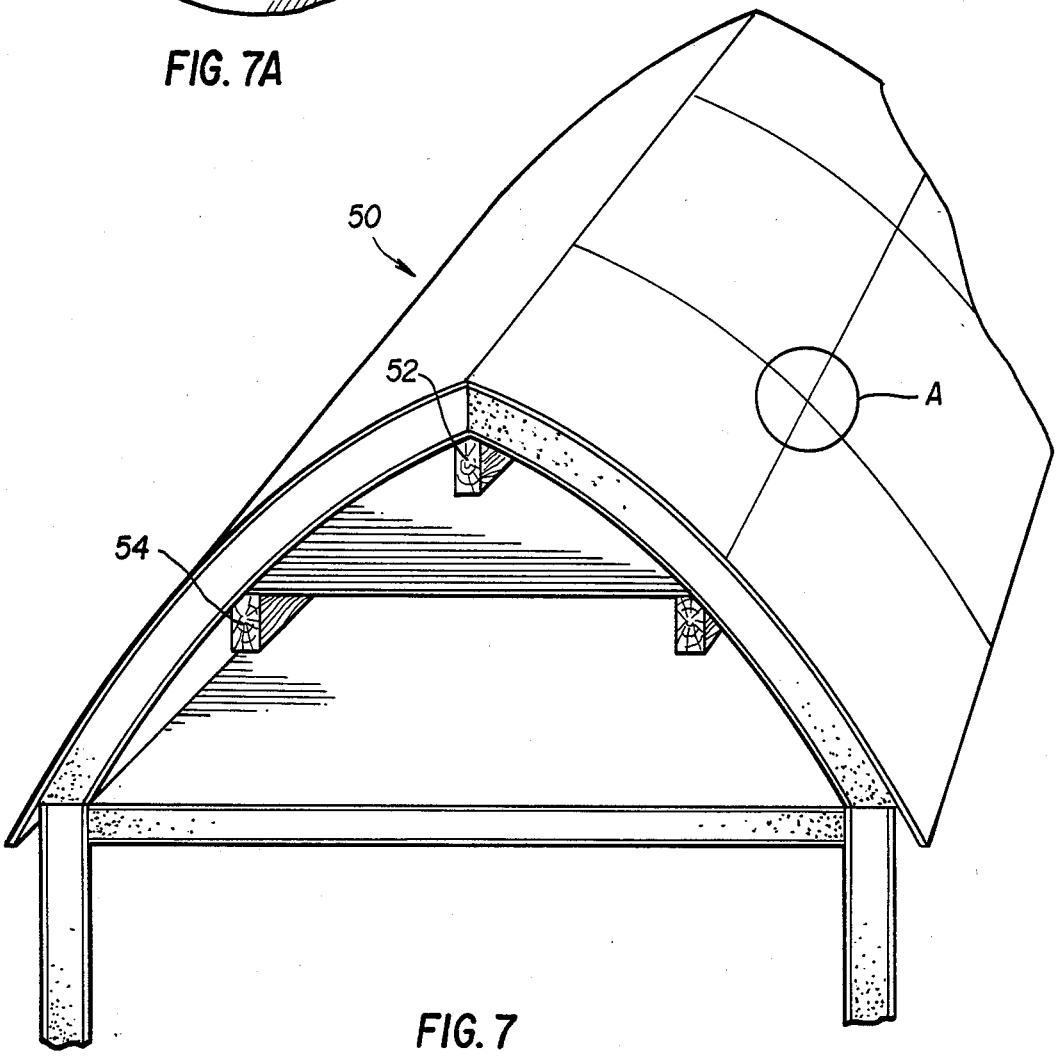

FIG. 4A–G are illustrations of various types of joints which will continue the panel strength through the joint;

FIG. 5 are illustrates the adhesive applied to at least one shorter edge;

FIG. 6 illustrates the detail of the captured scarf joint used on the edges of the panel;

FIG. 7 illustrates the use of the bowed prefabricated structural panels assembled to form the roof of a house such as a BOWED ROOF CAPE or BOWED CAPE.

FIG. 7A is a detail of four panels in edge-to-edge relationship showing the scarf joint as an example of useful joints.

DESCRIPTION OF THE PREFERRED EMMBODIMENTS

In order to more clearly describe and disclose the invention for the most part of the panel will be described as having substantially uniform thickness, be rectangular in shape, having an insulative core of uniform thickness and bonded to two skins. The structure using the panels will generally be described as a bowed roof structure such as the bowed roof cape house. It is understood that there are many variations relative to the panels and the structures. Panels having a core of varying thickness varying core materials and varying sizes are all within the scope of the invention disclosed herein. Bowed roofs with or without bowed walls; roofs which are concave rather than convex; roofs which are dome shaped all taken together are generically referred to as non-planar and are within the scope of the invention disclosed herein.

It is important to note that the tension (or tensile) and the compression forces which exist when the panels are assembled to form a wall or a larger structure from a plurality of panels, are transmitted through the joints so that the wall behaves as a single unit. One cannot tell after a wall is assembled using the panels disclosed herein where the joints are located because of the skin strength continuity that results when the panels are tightly joined, using for example glue as a fastening means. There is what appears to be a homogeneous distribution of the tension and compression forces thoughout the structure made up of the tightly joined panels.

Figure 1:
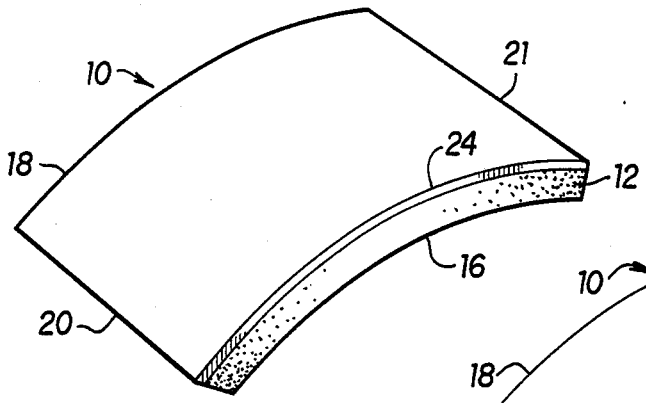
FIG. 1 is a perspective view of the bowed prefabricated panel having an outer skin only according to the present invention.
Figure 2:
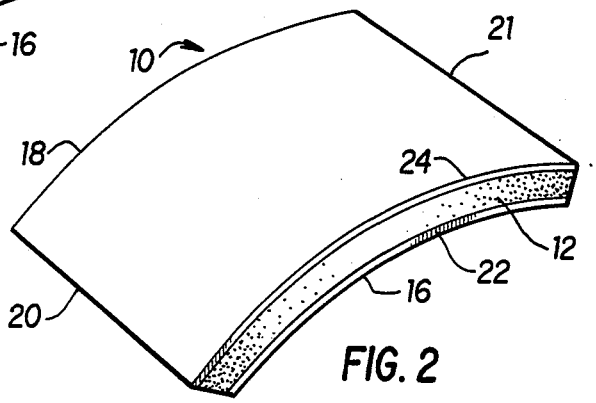
FIG. 2 is a perspective view of the bowed prefabricated panel having an outer skin and an inner skin according to the present invention.
Figure 3:
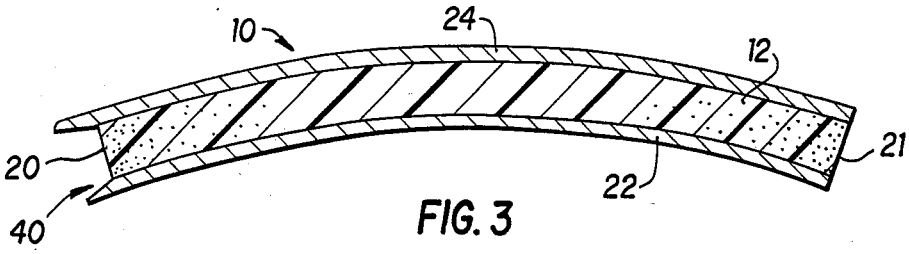
FIG. 3 is a side view of the panel illustrating the captured scarf joint on the shorter edge of the panel and the bow from one short edge to another short edge.

Referring now to the embodiments shown in FIGS. 1 and 2 which illustrates a prefabricated panel 10. The preferred embodiments of panel 10 has an insulative core 12 which core 12 has substantially uniform thickness bonded to an outer skin 24 as in FIG. 1 and to an outer skin 24 and an inner skin 22 as shown in FIG. 2. It is of course understood that the core may be material other than an insulative material such as for example a paper honeycomb or any other material which could function as a core for the panels. The outer skin 24 may be material such as plywood, wafer board, particle board or oriented strand board or material over which siding or roof shingles may be attached. The inner skin 22 may be gypsum board, plywood or other material which may be used for the interior wall or ceiling covering or as the base for the finished interior wall or ceiling. The panel is initially fabricated having a generally rectangular configuration with longer edges 16 and 18 and two shorter edges 20 and 21. The edges 20, 21, 16 and 18 defining the size of the panel 10. The skins 22 and 24 are typically attached to the core 12 when the core 12 is fabricated. After the panel 10 is fabricated, a joint 40 may be machined, or molded or cut into the appropriate edges of the panel 10 in such a manner so that when panels are assembled together in edge-to-edge relationship the adjacent edges of the assembled panels abuttingly match. It should be pointed out that where structural bowed prefabricated panels are used, it is within the scope of the invention to simply abutt the edges of adjacent panels where the edges 16, 18, 20 and 21 are substantially planar as compared to having a particular joint configured thereon. When the edges are substantially planar, splines may be used to align and secure adjacent panels to each other. In particular where in-the-field assembly is to be used a micro encapsulated adhesive 36 of FIG. 5 is applied to at least one of the edges.

Upon assembling panels 10 in order to form walls, or roofs it has been found that the captured scarf joint 40 permits the effective assembly of panels 10 using only the adhesive 36. When the panels 10 are assembled the adhesive is caused to become activated upon pressure being applied to the captured scarf joint 40 and upon the adhesive 36 which has been applied to one or both of the complementary mating edges 42 and 44 of the joint 40 thus eliminating the need for splines or stud posts. It has been observed that because of the special angles and unique characteristics of the captured scarf joint 40, the panels 10 being jointed, are captured, very easily aligned and securely held in position. In addition to the larger bonding area provided by the captured scarf joint 40 the joint 40 is not tight until it is completely closed thereby causing a very tight and continuous inner skin 22 and outer skin 24. That is to say that the inner and the outer skins of joined panels being tight and continuous is meant to convey the notion that the skin strength from panel to panel appears or behaves as a continuous skin without joints would appear from a structural and a strength standpoint.

When panels 10 of the instant invention are used, for example, to fabricate a non-planar roof diaphram 50 of, for example the so called bowed roof cape as illustrated in FIG. 7, the captured scarf joint 40 having a male portion 42 and female portion 44 as illustrated in FIG. 6 and in FIG. 7A may be machined onto the sorter edges 20 and/or 21 and the longer edges 16 and/or 18 of panels 10 thereby permitting the joining of panels 10 not only along the linear edges 16 and 18 but also along the shorter edges 20 and/or 21. The manufacturers of the most commonly used roof covering or sheathing recommend leaving a substantial space between pieces. As the sheathing swells or contracts, the roof shingles wrinkle or buckle. The fabricated roof diaphram using the panels 10 solves the problems or wrinkling of roof shingles or waferboard roof deck because it eliminated the movement toward the joint or joints 40. By glueing the panels 10 of the instant invention the entire roof assembly 50 behaves as a single diaphragm absorbing and/or distributing the stresses of expansion. Additionally it should also be noted that the roof deck or diaphram 50 is fastened to the roof framing system as seen in FIG. 7 which includes a ridge 52 and at least one beam 54 parallel to and displaced from the ridge 52 by an amount about equal to the length of panel 10. The framing system comprising beam 54 and ridge 52 thereby configured to support a plurality of panels 10. The roof 50 may be constructed without the need to nail or screw through the entire panel thickness which eliminates nails and screws as thermal bridges. Additionally where the span of the roof relative to the thickness of the panels 10 permits, beams 54 are not necessary. Where the end walls of the structure are tied to, for example a floor, the ridge 52 is not essential or necessary.

It is thought that the prefabricated panel 10 of the present invention and many of its attendant advantages including its use in a method for constructing a building structure such as the bowed roof 50 for a building such as for a so called bowed roof cape house, will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. Prefabricated structural building panels at least some of said panels comprising:

a substantially homogeneous core having substantially uniform thickness bonded to at least one adjacent skin, said skin being of material different from said homogeneous core, said core and said skin in combination having a substantially non-planar shape and first and second pairs of opposed panel edges, said first pair of opposed panel edges being parallel and being substantially non-linear and extending between said second pair of opposed panel edges, said second pair of opposed panel edges being parallel and substantially linear, said at least one adjacent skin further having a first cross sectional area parallel to said first pair of edges and a second cross sectional area parallel to said second pair of edges;

said first pair of opposed and parallel panel edges having an edge configuration adapted to abuttingly interfit first edges of substantially identical panels said edge configuration lying solely in the plane of said at least one adjacent skin having a surface area substantially greater than said first cross sectional area of said skin and being of a character such that when a plurality of said panels are assembled in mating edge to mating edge relationship, tensile and compression forces are transmitted between adjacent panels in the plane of said skins; and said second pair of opposed, linear and parallel panel edges having an edge configuration adapted to abuttingly interfit second edges of substantially identical panels, said edge configuration lying solely in the plane of said at least one adjacent skin, having a surface area greater than said second cross sectional area of said skin, and being of such a character that when a plurality of said panels are assembled using a fastening means tensile and compressive forces are transmitted between adjacent panels in the plane of said skins.

2. The prefabricated structural building panel according to claim 1 wherein said core comprises insulative material.

3. The prefabricated structural building panel according to claim 2 wherein there are two skins, an outer and an inner skin, having said core bonded thereto and therebetween and wherein at least one of said skins is material different from said core material and selected from waferboard, oriented strand board, fiberboard, plaster board, sheetrock, wood panel, wire, wire reinforced paper, pressboard, particle board, plywood, metal and plastic.

4. The prefabricated structural building panel according to claim 3 wherein said inner skin and said outer skin having a predetermined thickness and sized substantially the same as said panel, said inner skin and said outer skin each respectively having inner skin edges, and outer skin edges corresponding to said first and second pair of panel edges; and a joint selected from the group consisting of, captured scarf joint, finger joint, mortise and tenon joint, locking lap joint and tongue and groove joint, a male portion of said joint configured onto one of said inner and outer skin edges corresponding to the one edge of said first pair of panel edges and a female portion of said joint configuration onto the other of said inner and outer skin edges corresponding to the other edge of said first pair of panel edges whereby upon tightly joining a plurality of said prefabricated panels the tensile and compression forces are transmitted between adjacent panel skins.

5. The prefabricated structural building panel according to claim 2 further comprising a micro-encapsulated adhesive applied onto at least one of the panel edges.

6. The prefabricated structural building panel according to claim 4 further comprising a micro-encapsulated adhesive applied onto at least one of the surfaces of said joint.

7. The prefabricated structural building panel according to claim 4 wherein said joint is a captured scarf joint.

8. The prefabricated structural building panel according to claim 7 further comprising a second captured scarf joint configured onto the skin edges corresponding to each panel edge of the second pair of panel edges, a male portion of said second joint onto one pair of said inner and outer skin edges corresponding to one edge of the second pair of panels edges, and a female portion of said second joint onto the other pair of said inner and outer skin edges corresponding to the other edge of the second pair of panel edges.

9. The prefabricated structural building panel according to claim 8 further comprising a micro-encapsulated adhesive applied onto at least one of the surfaces of said male and female portions of said second joint.

10. The prefabricated structural building panel according to claim 4 wherein said at least one defining surface is said roof which panels when used at least in pairs define a building having a non-planar roof thereon.

11. A bowed roof of a building, said building being suitable for human habitation, said roof comprising a framing system having a ridge and at least a beam said framing system configured to support a plurality of bowed prefabricated structural insulative building panels arranged in edge-to-edge relationship said framing system is a system which is separate from said panels at least some of said panels comprising:

a substantially homogeneous core having substantially uniform thickness bonded to two adjacent skins, an outer and an inner skin, said skin being of material different from said core material and said skins having, therebetween and bonded thereto, said core of insulative material, said core and said skins in combination, being substantially rectangular with two short panel edges and two long panel edges said two short edges being linear, opposed and parallel one to the other and said two long edges being opposed and parallel and said two long edges having a bowed shape with a radius from one of the short edges to the other of the short edges, said radius of appropriate magnitude, at least one of said two adjacent skins further having a long cross sectional area parallel to said long panel edges and a short cross sectional area parallel to said two short panel edges;

the two opposed, linear and parallel short panel edges having an edge configuration adapted to abuttingly interfit short edges of abutting panels when said abutting panels are placed in abutting and interfitting relationship, said edge configuration lying solely in the plane of said at least one of said two adjacent skins and having a surface area greater than the short cross sectional area of said skin at at least one of said short panel edges and said configuration of at least one short edge of said two opposed, linear and parallel short edges of a character such that when a plurality of said panels are assembled in mating edge to mating edge relationship, tensile and compression forces are transmitted between adjacent panels in the plane of said skins and one of the two linear, parallel and opposing short edges of said panels and said abutting panels may be abutting at said beam; and said two long opposed and parallel edge having an edge configuration adapted to abuttingly interfit long edges of substantially identical panels which are placed in abutting and interfitting relationship, said edge configuration lying solely in the plane of said at least one adjacent skin and having a surface area greater than the long cross sectional area of said skin at at least one of said long panel edges and said configuration of at least one long edge of said two opposed and parallel long edges of a character such that when a plurality of said panels are assembled in mating edge to mating edge relationship, tensile and compression forces are transmitted between adjacent panels in the plane of said skins such that an assembly of a plurality of said panels onto said framing system results in said bowed roof.

12. A bowed roof building according to claim 11 wherein said inner skin and said outer skin having a predetermined thickness and sized substantially the same as said panel, said inner skin and said outer skin each respectively having inner skin edges, and outer skin edges corresponding to said first and second pair of panel edges;

at least one of said skins is material different from said core material and selected from waferboard, oriented strand board, fiberboard, plaster board, sheetrock, wood panel, wire, wire reinforced paper, pressboard, particle board, plywood, metal and plastic; and a joint selected from the group consisting of, captured scarf joint, finger joint, mortise and tenon joint, locking lap joint and tongue and groove joint, a male portion of said joint configured onto one of said inner and outer skin edges corresponding to the one edge of said first pair of panel edges and a female portion of said joint configured onto the other of said inner and outer skin edges corresponding to the other edge of said first pair of panel edges whereby upon tightly joining a plurality of said prefabricated panels, using a means for joining, the tensile and compression forces are transmitted between adjacent panel skins.

13. The bowed roof of a building according to claim 12 further comprising a micro-encapsulated adhesive applied onto at least one of the surfaces of said joint.

* * * * *